US005988904A

United States Patent [19]

Brugue et al.

[11] Patent Number: 5,988,904

[45] Date of Patent: Nov. 23, 1999

[54] REMOVABLE ROLLFEED APPARATUS FOR A DESK-MOUNTABLE PRINTER

[75] Inventors: Joaquim Brugue; Antonio Hinojosa; David Claramunt, all of Sant Cugat, Spain

[73] Assignee: Hewlett-Packard Company, Palo Alto, Calif.

[21] Appl. No.: 08/922,030

[22] Filed: Sep. 2, 1997

[51] Int. Cl.[6] ..... B41J 11/26

[52] U.S. Cl. ..... 400/613; 400/691

[58] Field of Search ..... 400/611, 613, 400/613.1, 613.2, 613.3, 616, 616.1, 616.2, 616.3, 636, 578, 691; 347/101, 104

[56] References Cited

U.S. PATENT DOCUMENTS

| | | | |
|---|---|---|---|
| 1,159,404 | 11/1915 | Martin | 400/613 |
| 1,951,838 | 3/1934 | Pfeiffer et al. | 400/613 |
| 2,014,884 | 9/1935 | Euth | 400/613 |
| 4,764,041 | 8/1988 | Bierhoff | 400/613 |
| 5,376,959 | 12/1994 | Rall | 347/104 |
| 5,706,729 | 1/1998 | Tai et al. | 400/613 |

FOREIGN PATENT DOCUMENTS

| | | | |
|---|---|---|---|
| 0195572 | 9/1986 | European Pat. Off. | 400/616 |
| 0152769 | 7/1987 | Japan | 400/611 |
| WO93/13946 | 7/1993 | WIPO | 400/613 |

*Primary Examiner*—Eugene Eickholt
*Attorney, Agent, or Firm*—David S. Romney

[57] ABSTRACT

A removable rollfeed apparatus, adapted to be rigidly attached to a printer, holds a roll of media and is mountable on the underside of the printer. The attachment to the underside of the printer allows a desk-mountable printer to rest on the rollfeed apparatus and thus to be raised away from the desk. In an embodiment the rollfeed apparatus itself has feet which are utilized in place of any feet mounted directly on the printer and extends to the front of the printer so that the media shaft is held in front of and below the printer. Furthermore there is provided a printer having mounting positions on the underside of the printer for mounting i) feet on which the printer may rest on a desktop, ii) legs on which the printer may rest on a floor, and iii) rollfeed apparatus. This enables both desktop and freestanding printers to quickly and easily be configured with or without a rollfeed apparatus.

12 Claims, 16 Drawing Sheets

REMOVABLE ROLLFEED APPARATUS FOR A DESK-MOUNTABLE PRINTER

FIELD OF THE INVENTION

The present invention relates to a removable rollfeed apparatus for a printer and to a printer suitable for the rollfeed apparatus, and in particular to an easily removable rollfeed apparatus mountable on the underside of a printer.

BACKGROUND TO INVENTION

Printers such as inkjet printers which print on a variety of print media such as paper, vellum or film are well known. Some larger printers, sometimes known as large-format printers, as well as accepting print media in single sheet format, also accept print media fed from a roll of media held by a rollfeed apparatus. The rollfeed apparatus releasably holds both ends of a shaft on which a roll of media is mounted and may provide braking to the rotation of the shaft to improve the feeding of media into the printer. The more expensive of these printers often integrally include such rollfeed apparatus when the printer is sold. However for less expensive models of printer which are sold without an integral rollfeed apparatus, or in order to provide a greater choice of models to a customer, it is known to provide a removal rollfeed apparatus.

Commonly assigned application U.S. Ser. No. 08/658,346, filed Apr. 29, 1996, entitled REMOVABLE ROLLFEED APPARATUS AND METHOD now issued as U.S. Pat. No. 5,815,186 discloses a unitary rollfeed apparatus that is pivotally mountable on the front of a free-standing printer. As can be seen in FIG. 1, this prior art rollfeed apparatus 1 comprises a substantial frame assembly having a number of strengthening and stiffening elements 2 and 3 in addition to means 4 and 5 for holding a roll of media. The whole of this large and unwieldy rollfeed apparatus must then be hung onto the front of the printer utilising mounting points 6 and 7 as described in the referenced application. Although the legs for the printer are not shown in FIG. 1, it should be noted that this prior art removable rollfeed apparatus can only be utilised with free-standing printers having legs and cannot be utilised with a desk-mountable printer.

BRIEF SUMMARY OF THE INVENTION

The present invention provides an easily attachable rollfeed apparatus that can be utilised with a desk-mountable printer. What is disclosed is a removable rollfeed apparatus adapted to be attached to a printer comprising support means for holding a roll of media wherein said support means are mountable on the underside of the printer. The attachment to the underside of the printer allows a desk-mountable printer to rest on the rollfeed apparatus and thus to be raised away from the desk. Preferably the rollfeed apparatus itself has feet which are utilised in place of any feet mounted directly on the printer and preferably the support means extends to the front of the printer so that the media shaft is held in front of and below the printer.

The rollfeed apparatus of the present invention can advantageously also be mounted to a free-standing printer having legs. Thus a further aspect of the invention provides a printer suitable for printing on media fed into the printer from a roll of media and having mounting positions on the underside of the printer for mounting i) feet on which the printer may rest on a desktop, ii) legs on which the printer may rest on a floor, and iii) rollfeed apparatus.

In a further aspect the invention provides a printing system comprising a desk-mountable printer suitable for printing on media fed into the printer from a roll of media, a stand for converting the desk-mountable printer to a free-standing printer and removable rollfeed apparatus mountable on the printer, wherein said printing system is configurable as a desk-mounted printer without rollfeed apparatus attached, a desk-mounted printer with rollfeed apparatus attached, a free-standing printer without rollfeed apparatus attached, and a freestanding printer with rollfeed apparatus attached.

A more complete understanding of the present invention and other objects, aspects, aims and advantages thereof will be gained from a consideration of the following description of the referred embodiment read in conjunction with the accompanying drawings provided herein.

DETAILED DESCRIPTION OF THE PREFERRED EMBODIMENT OF THE INVENTION

Figure 1:
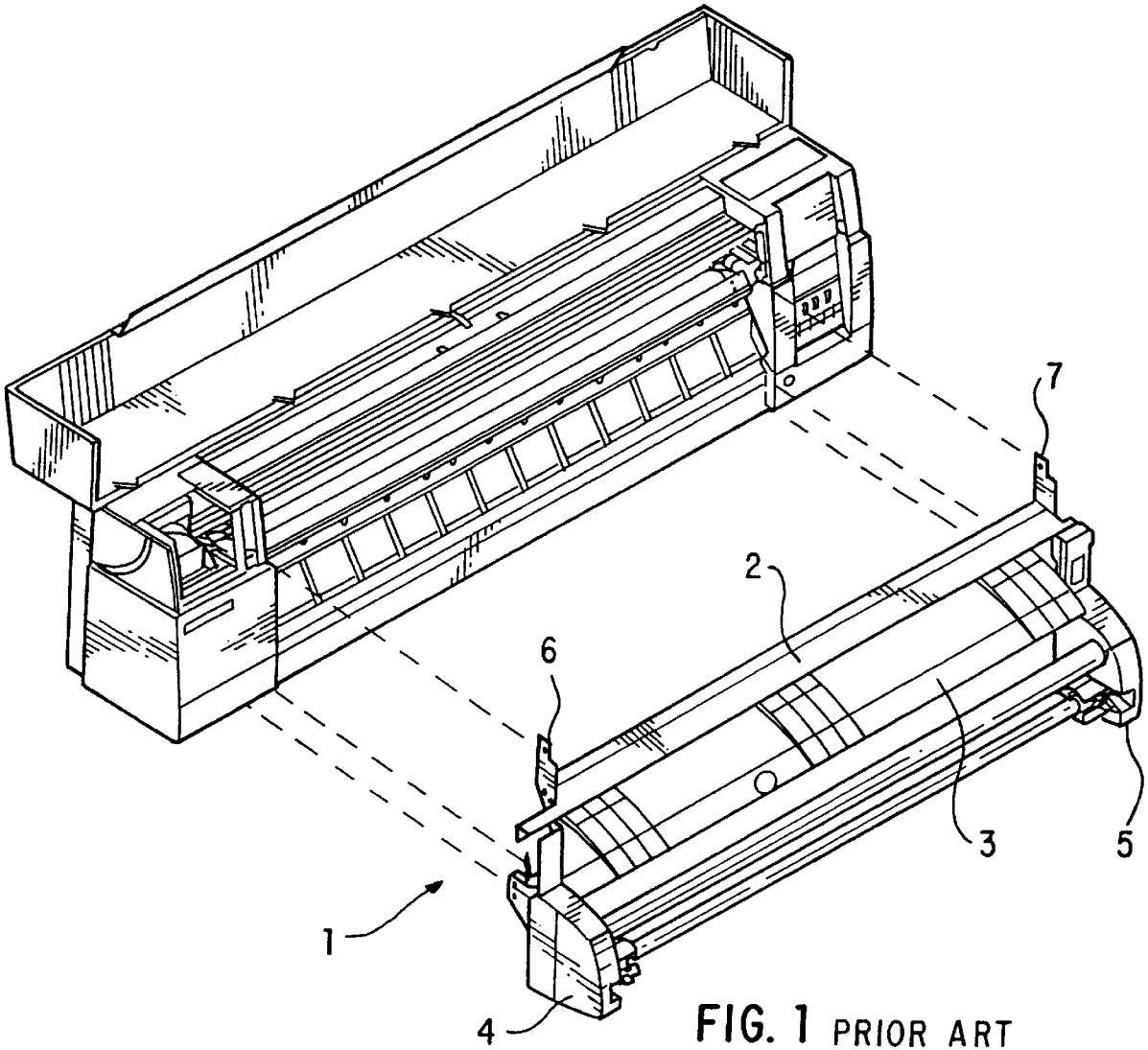
FIG. 1 PRIOR ART
FIG. 1 is a schematic perspective view of a prior art removable rollfeed apparatus and printer.

While the present invention is open to various modifications and alternative constructions, the preferred embodiments shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

Figure 2A:
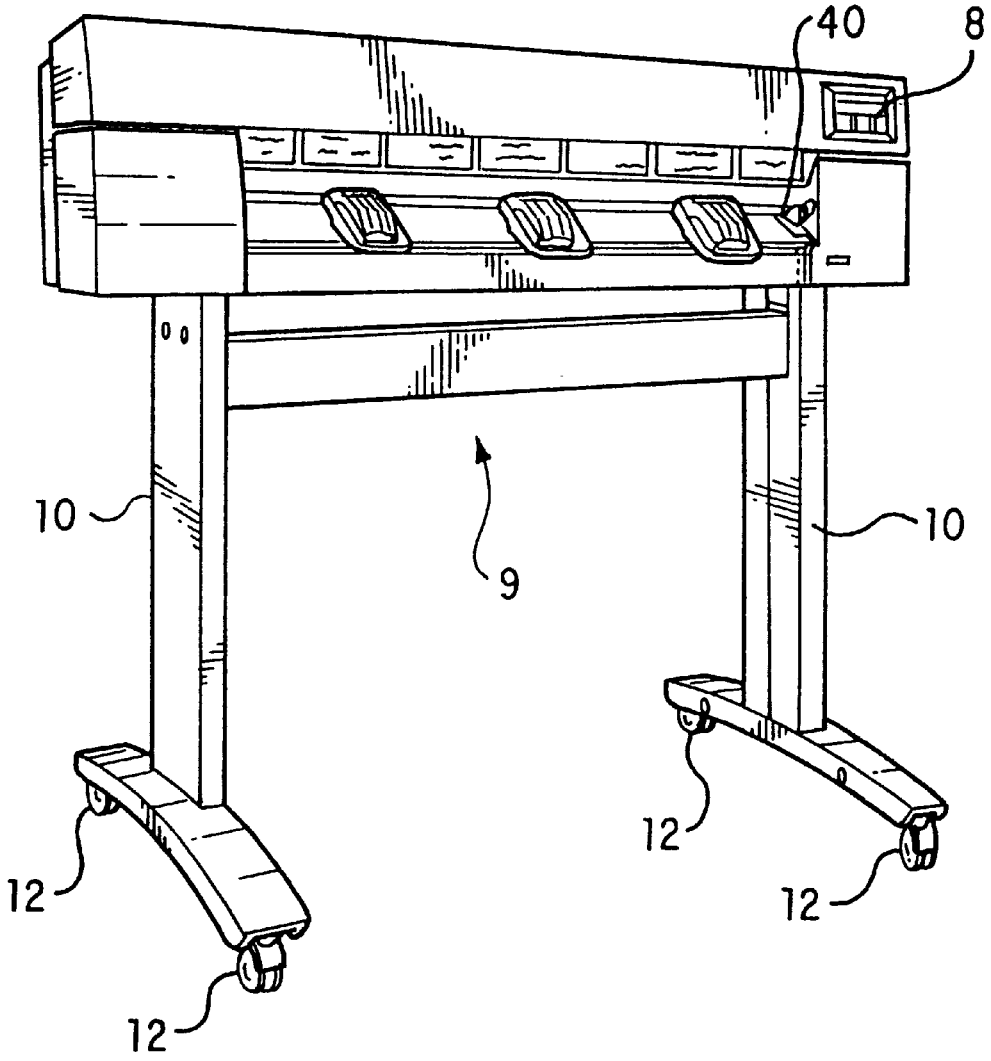
FIG. 2A is a schematic perspective view a free-standing printer having legs and FIG. 2B is a side view of the same printer.
Figure 2B:
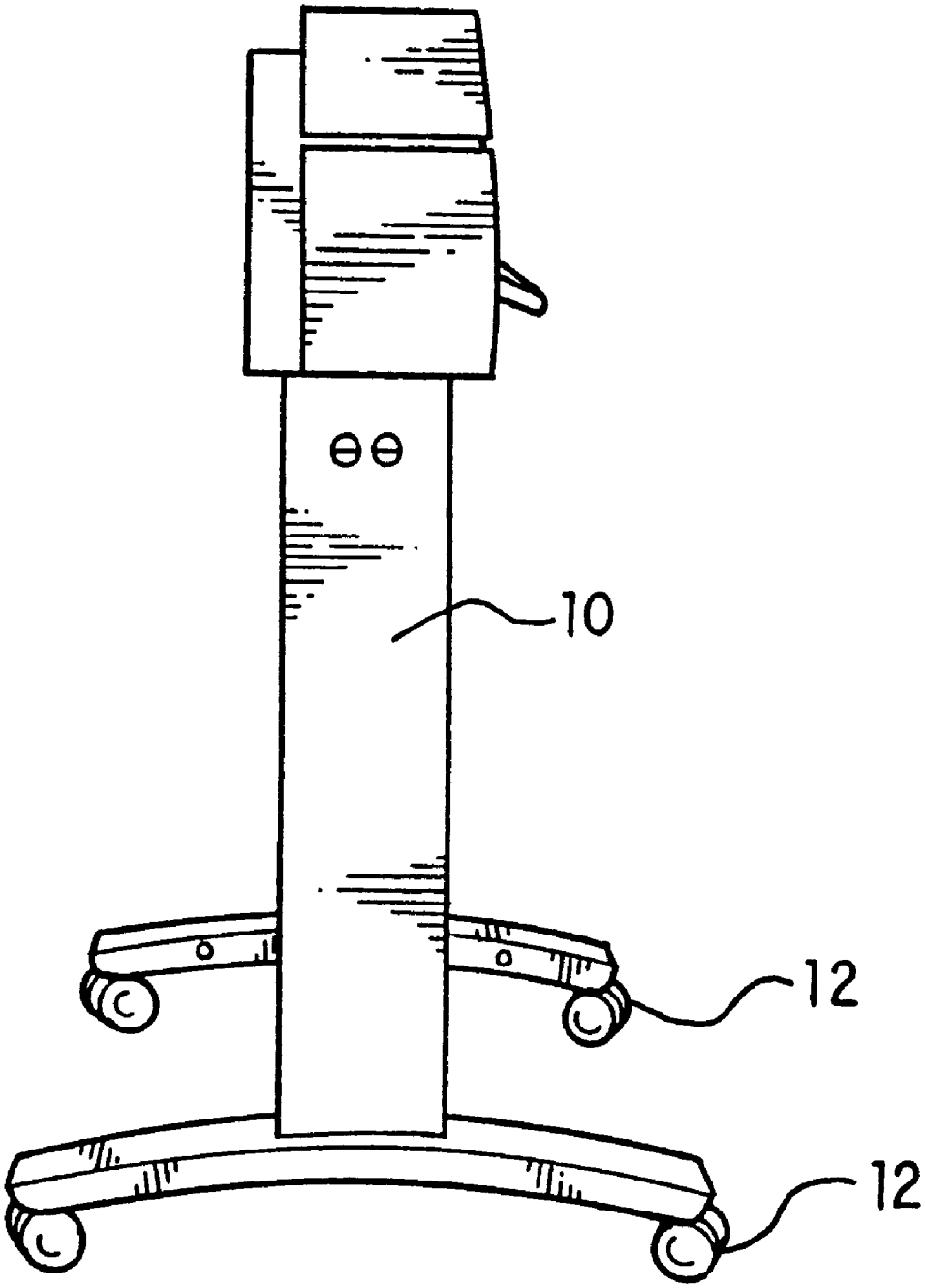
Figure 3A:
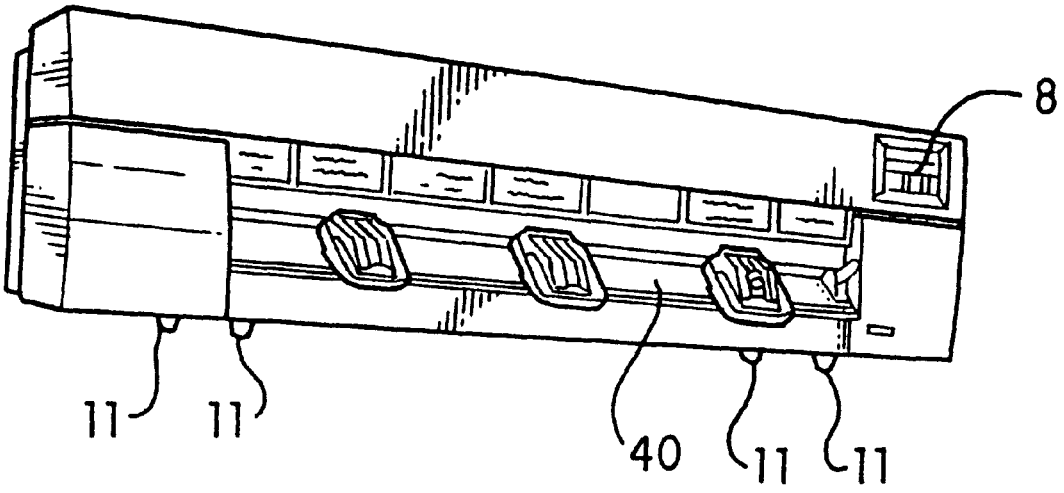
FIG. 3A is a schematic perspective view a desk-mountable printer having feet and FIG. 3B is a side view of the same printer.
Figure 3B:
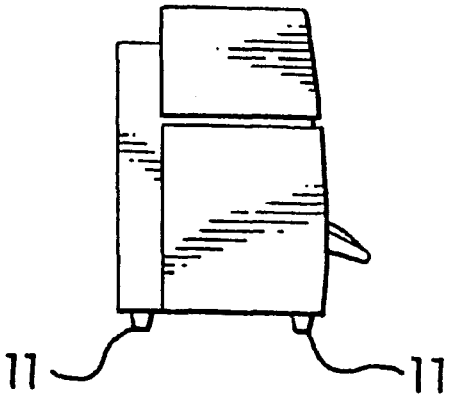

The rollfeed apparatus of the present invention operates in conjunction with a printer, for example an inkjet printer as shown in FIGS. 2A, 2B and 3A, 3B which does not have an integral rollfeed apparatus. FIGS. 2A and 2B show respectively a perspective and side view of a free-standing printer mounted on a stand 9 having legs 10 and wheels 12 while FIGS. 3A and 3B show respectively a perspective and side view of a desk-mountable printer having feet 11.

The printers include a control panel 8 having operating switches and lights to indicate the printers status and an entry platen 40 for receiving print media. These printers use inkjet technology to produce vibrant full colour or black and white outputs on various media in large-formats. Within the printers (not shown) are thermal inkjet cartridges mounted on a carriage for reciprocal motion on rods to allow the cartridge to move back and forth across a rotatable platen roller. Media moves around the platen in what can be termed the X-direction while the print carriage moves across the media in the Y-direction.

The Hewlett-Packard printers of the type just described are relatively inexpensive and are marketed to budget-conscious consumers. Thus, in a basic configuration the printers are intended to have media sheets fed one at a time through the printer. However, the printers may also accept media from a rollfeed apparatus which may be removably attached to the printer at the determination of an operator to allow the option of feeding the printer from a roll of media. The rollfeed apparatus of the present invention may be easily and quickly installed and removed from both the free-standing printer shown in FIGS. 2A and 2B and the desk-mountable printer shown in FIGS. 3A and 3B.

Figure 4A:
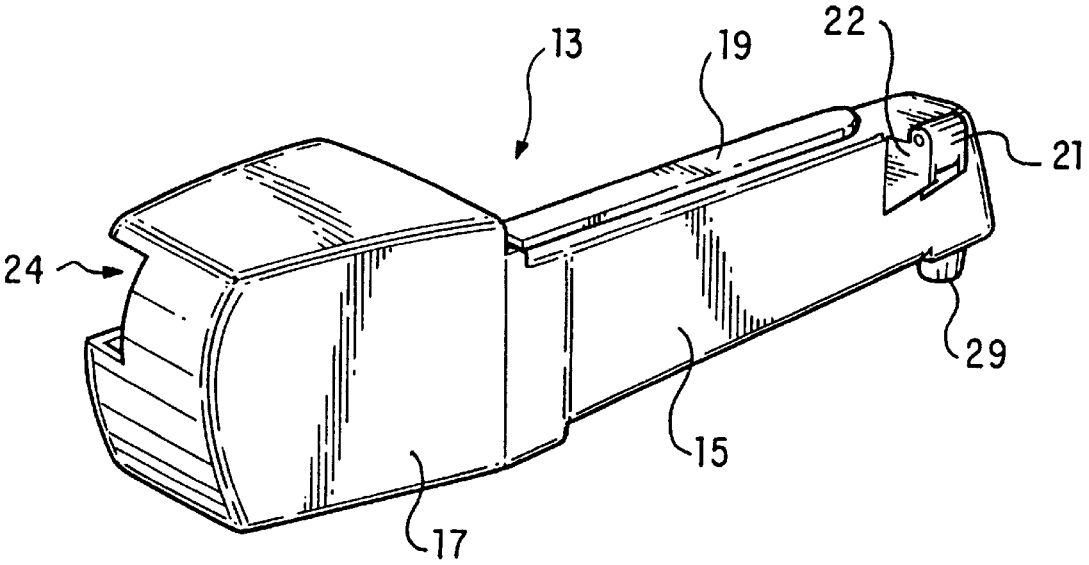
FIG. 4A is perspective view of the left side of a left rollfeed support.
Figure 4B:
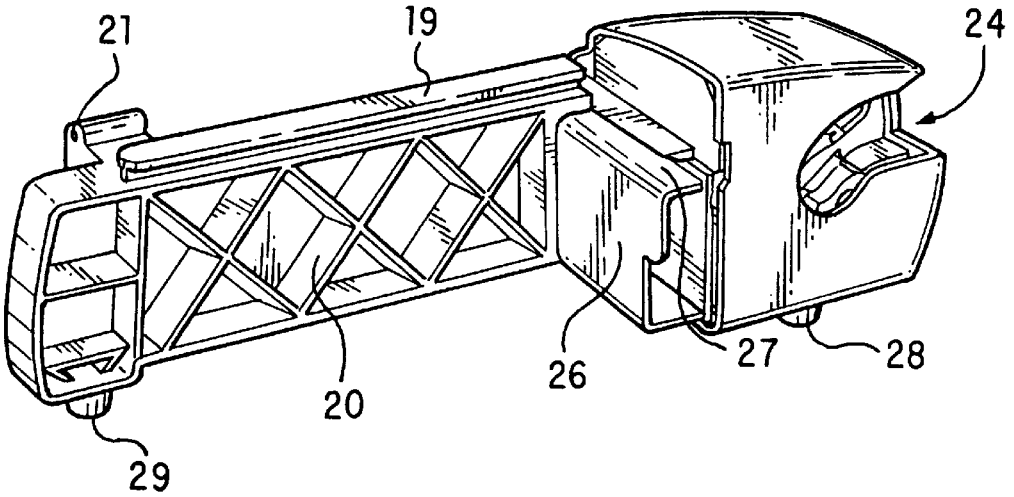
FIG. 4B is a perspective view of the right side of the same rollfeed support.
Figure 5A:
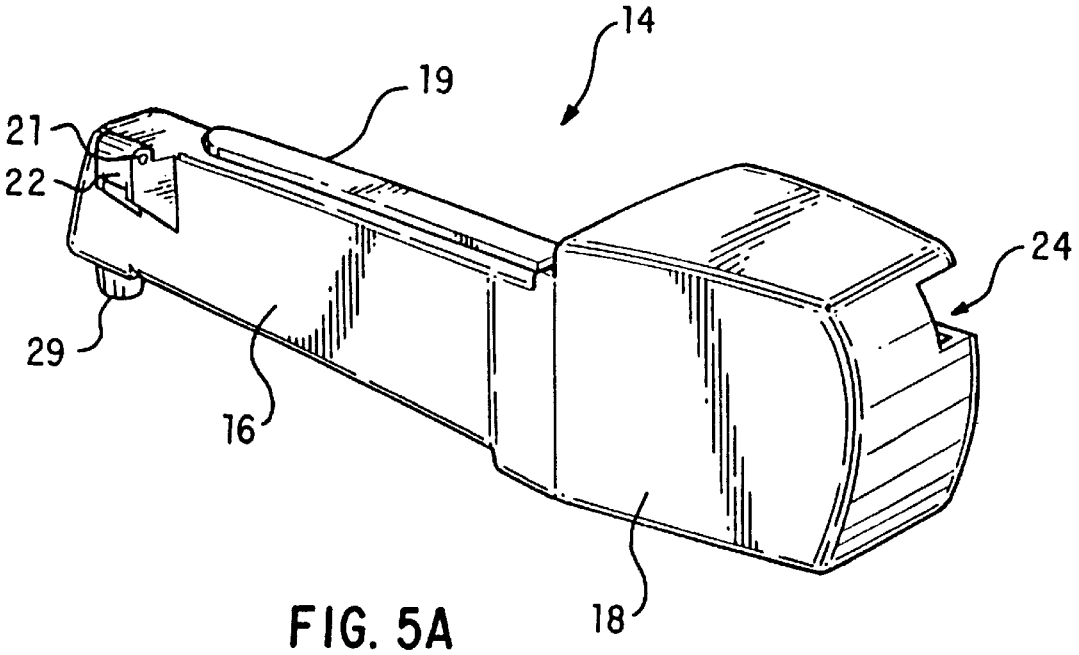
FIG. 5A is perspective view of the right side of a right rollfeed support.
Figure 5B:
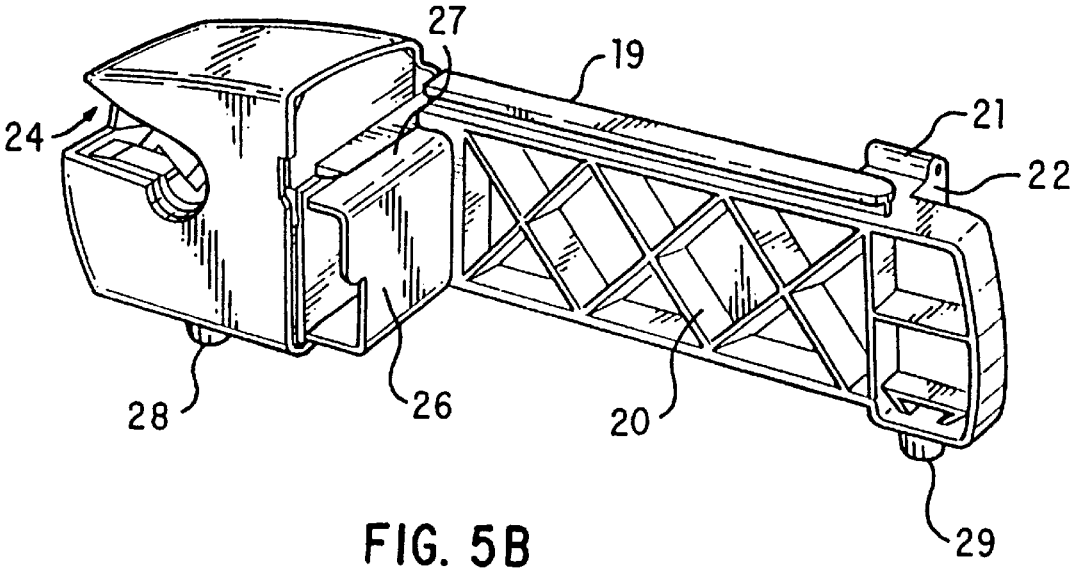
FIG. 5B is a perspective view of the left side of the same rollfeed support.
Figure 6B:
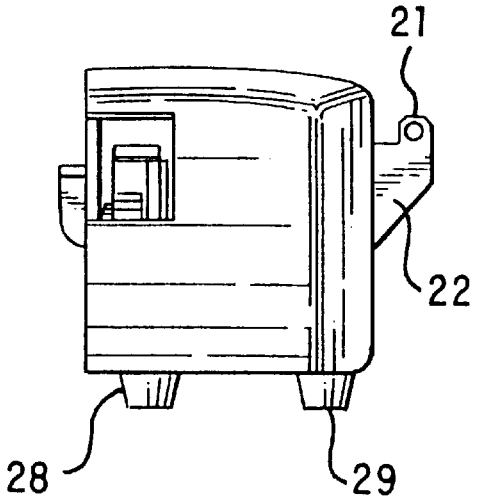
FIGS. 6A and 6B are respectively rear and front views of a left rollfeed support.
Figure 6A:
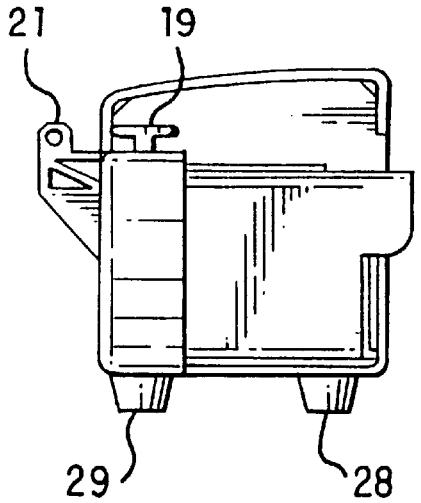
Figure 7A:
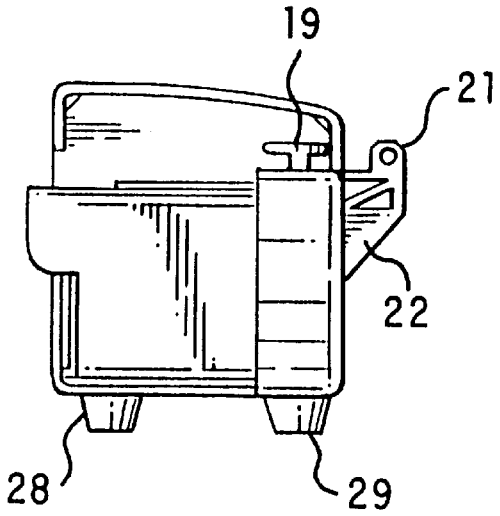
FIGS. 7A and 7B are respectively rear and front views of a right rollfeed support.
Figure 7B:
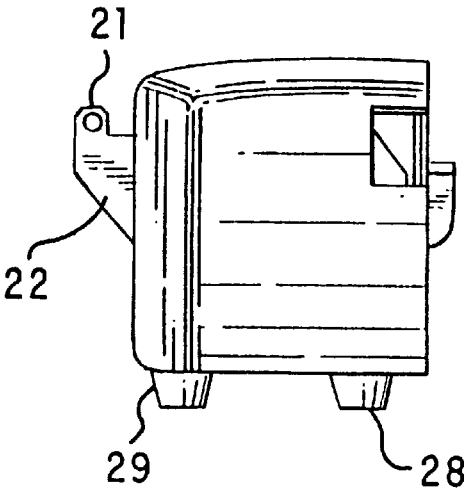

The rollfeed apparatus will now be described in detail with reference to FIGS. 4A, 4B and 5A, 5B and FIGS. 6A, 6B and 7A, 7B. The rollfeed apparatus comprises a pair of matched left and right rollfeed supports 13 and 14. The terms left and right are used herein relative to the printer itself, that is the left rollfeed support is attached to the left side of the printer (the side of the printer on an observers lefthand side when facing away from the printer). Each rollfeed support 13, 14 comprises an elongated portion 15, 16 and a housing portion 17, 18. On an upper part of each of the elongated portions 17, 18 there is a tongue 19 for engagement with a corresponding groove (described later) on the printer. The tongue 19 is curved at one end to facilitate entry into the groove on the printer and, as is best seen in FIGS. 6A and 7A, is of substantially T-shaped cross-section. The elongated portions 15, 16 have smooth faces on one of their sides, shown in FIGS. 5A and 4A, which are visible when the rollfeed supports are mounted on a printer and have numerous internal strengthening members 20 on their other sides, shown in FIGS. 4B and 5B, which are substantially not visible when the rollfeed apparatus is attached to a printer. At one end of each the elongate portions 15, 16 is an eyelet 21 on an arm 22 which extends somewhat away from the elongate portions 15, 16 as is best seen in FIGS. 6A, 6B and 7A, 7B. The eyelet is for receiving a fixing screw to fix the particular rollfeed support 13 or 14 to a printer as will be described later.

Figure 8:
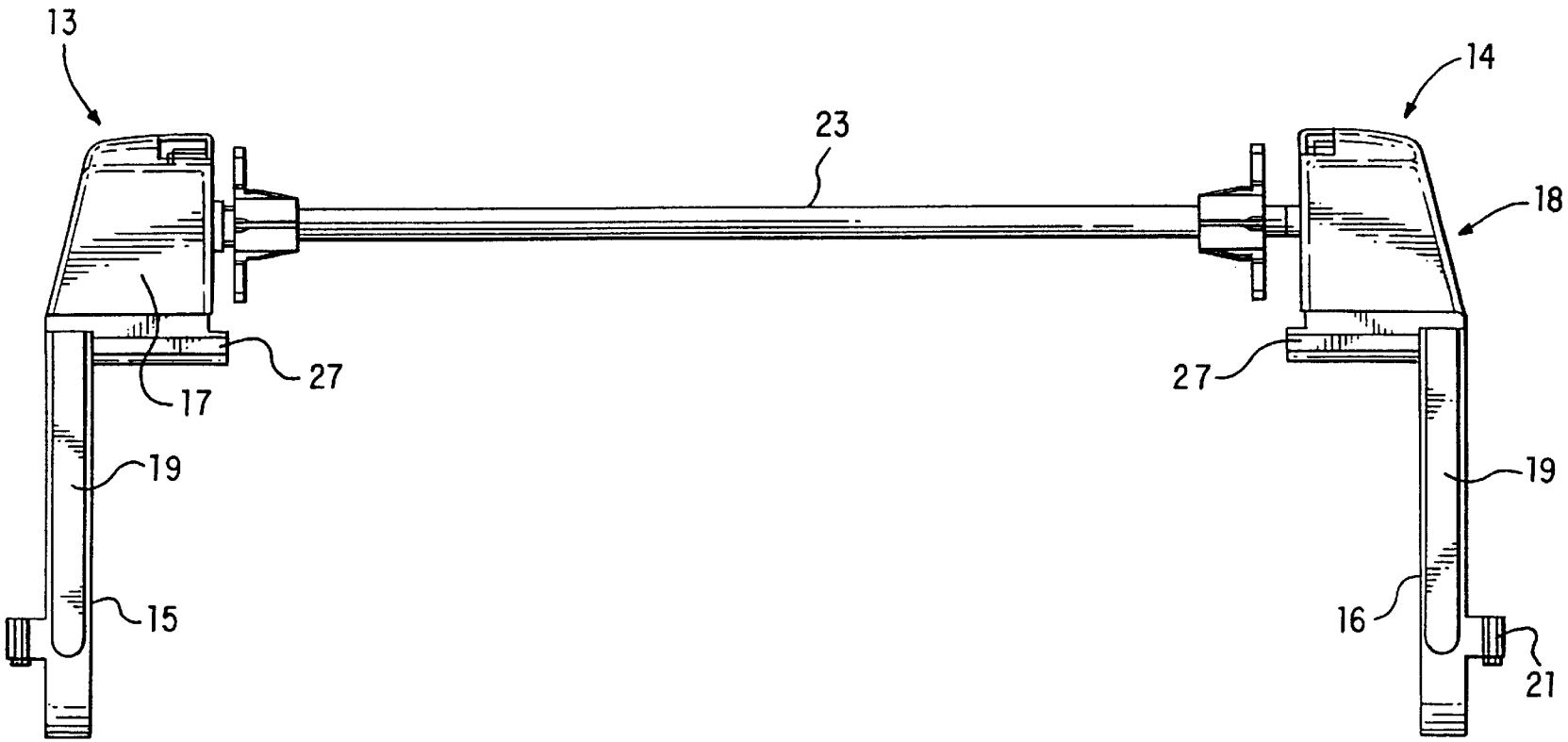
FIG. 8 is a plan view showing left and right rollfeed supports and a media shaft mounted between them.
Figure 9:
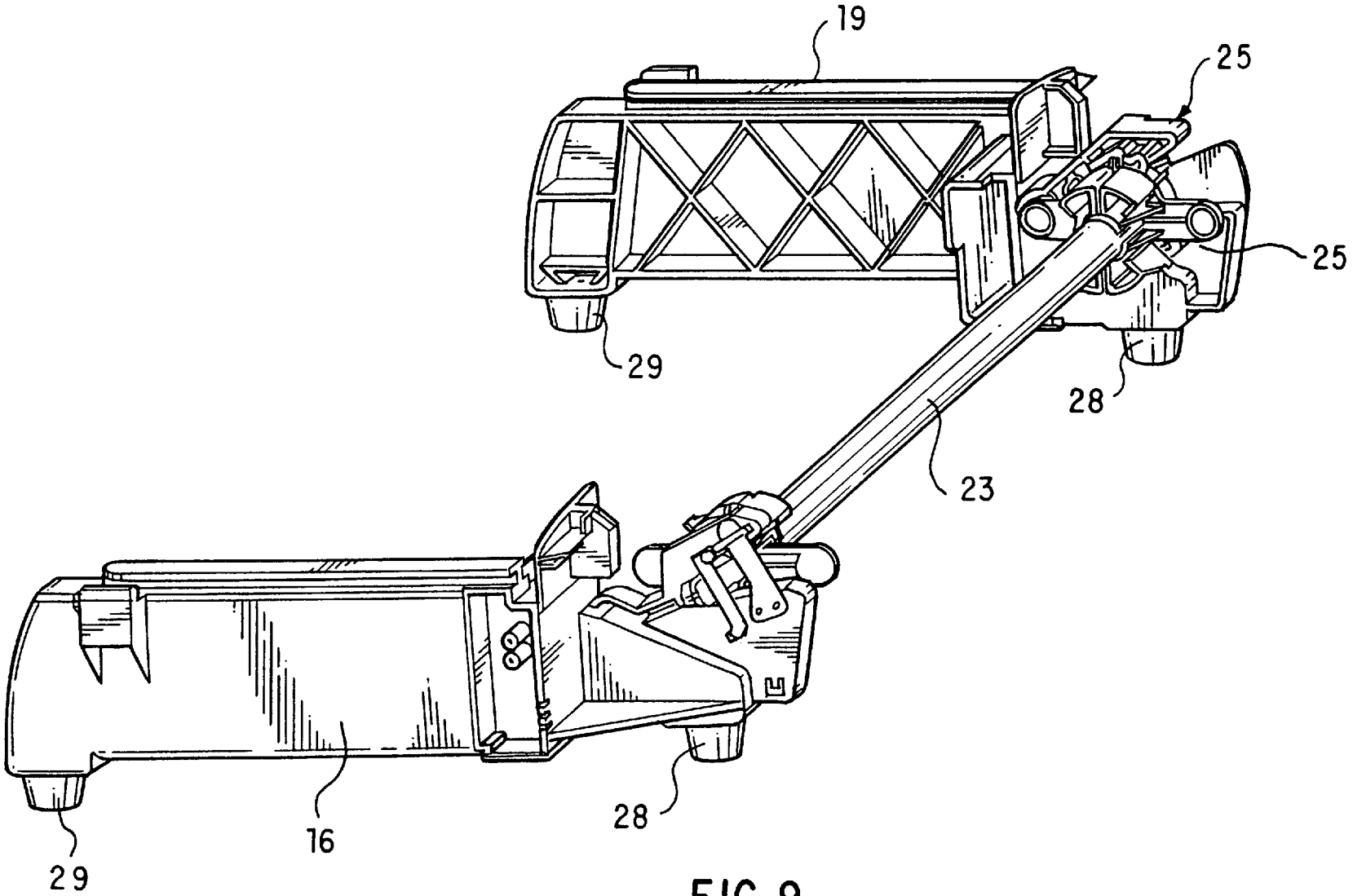
FIG. 9 is a perspective view of left and right rollfeed supports and a media shaft mounted between them in which the housing portion covers are not shown so that the media shaft holding means are seen.

FIGS. 8 and 9 show the two rollfeed supports with a media shaft 23 mounted between them for illustrative purposes alone, since in use the rollfeed supports need to be mounted on a printer prior to inserting the media shaft. The housing portions 17 and 18 of the rollfeed supports are generally cuboid and have a cover (which is shown removed in FIG. 9) for hiding from view the means for supporting each end of the media shaft 23. Each housing portion 17, 18 has a slot 24 into which an end of the media shaft 23 can be removably inserted and held. Hubs on each end of the media shaft 23 can be snapped into position in the slots 24 between arms 25 which are resiliently biased to grip, and in use brake, said hubs in a manner as for example is disclosed in commonly assigned application U.S. Ser. No. 08/658,346, filed Apr. 29, 1996, entitled REMOVABLE ROLLFEED APPARATUS AND METHOD by Lewis et al now issued as U.S. Pat. No. 5,815,186 which application is incorporated herein by reference. As can best be seen in FIG. 8, the housing portions 17 and 18 of the rollfeed supports 13 and 14 extend substantially at right angles from the elongate portions 15 and 16 of the rollfeed supports so that when mounted on a printer the housing portions substantially face each other. This offset of the housing portions from the elongate portions also aids in positioning the means for holding an end of the media shaft further towards the print zone of the printer and avoids fouling of the elongate portions on the legs 10 of the printer, as will be better appreciated later. With reference to FIGS. 4B, 5B, and 8, towards the back of each of the housing portions 17 and 18 there is provided a structural extension 26 having an upper surface 27 for receiving the foot 11 of a printer.

Referring now to FIGS. 4, 5, 6, 7 and 9, each rollfeed support 13, 14 has a front foot 28 and a rear foot 29 which, when the rollfeed supports are attached to a desk-mountable printer, act as the feet for the whole printer. In this case the weight of the printer is borne partially by the tongue 19 and partially by the upper surface 27 of the structural extension 26 of the housing portions.

As can be appreciated from FIGS. 4, 5, 6 and 7, the two rollfeed supports are substantially mirror images of each other both structurally and visually. This reduces design and manufacturing costs and is also aesthetically pleasing.

Figure 10A:
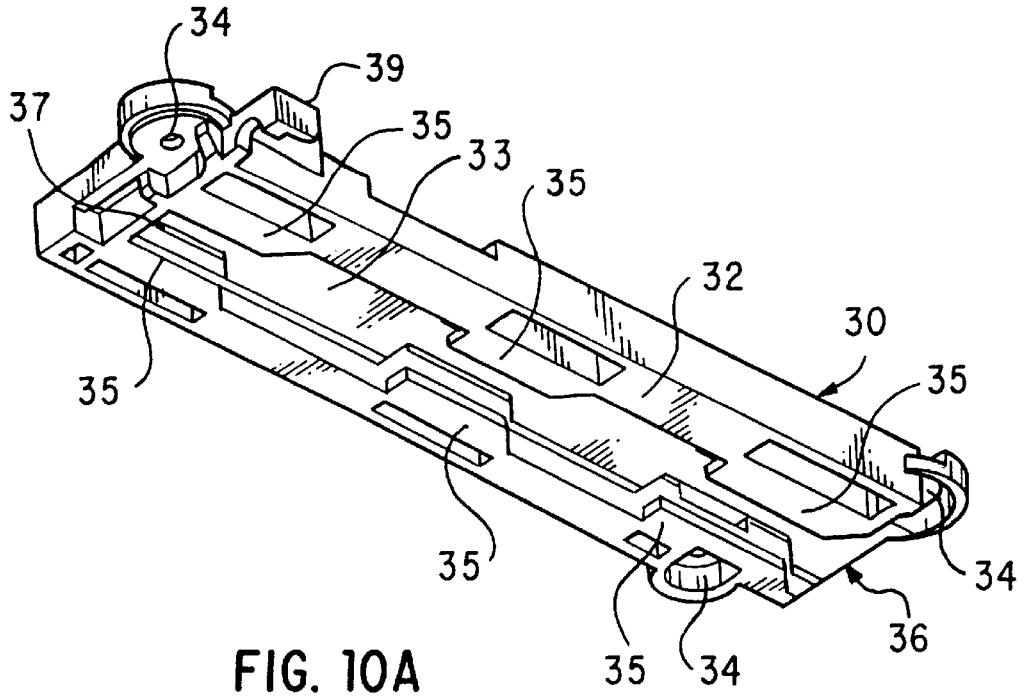
FIG. 10A is a perspective view of the lower side of a mounting plate and FIG. 10B is a perspective view of the upper side of the mounting plate.
Figure 10B:
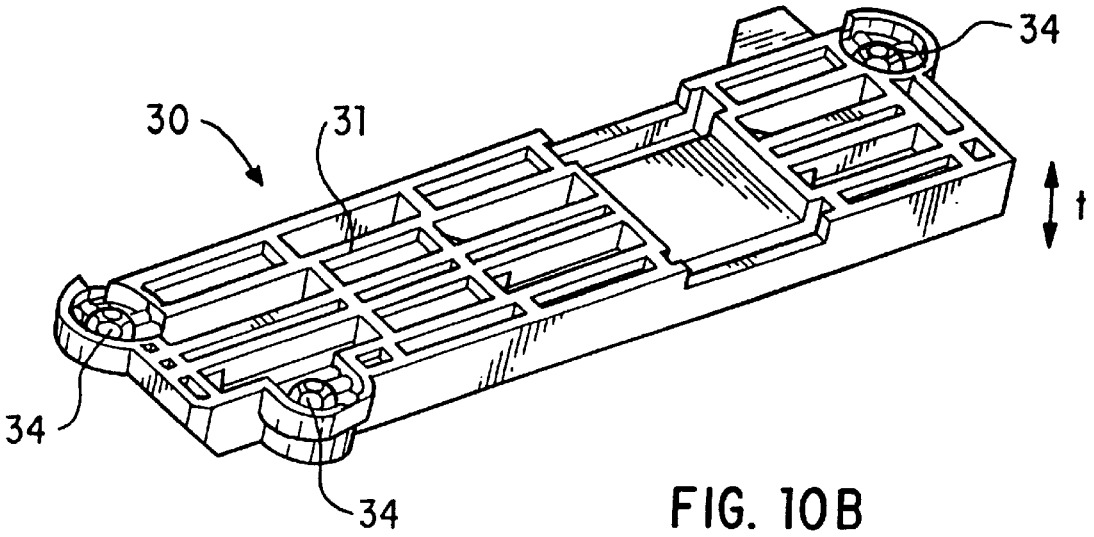

Although other mounting locations on a printer, for example on the sides of the printer, are envisioned, the specific embodiment described herein provides for the mounting of the rollfeed supports on the underside of the printer. The mounting arrangement will now be described in detail with reference to FIGS. 10, 11 and 12. A mounting plate 30 has an upper surface 31 shown in FIG. 10B which is mounted against the underside of a printer, and a lower surface 32 shown in FIG. 10A which has a groove 33 for receiving the tongue 19 of a rollfeed support. The upper surface 31 comprises numerous honeycomb-like structural segments to provide rigidity and low weight for a relatively thin plate. The mounting plate 30 is attached to the underside of a printer by means of screws locatable in the three holes 34 in the mounting plate. The groove 33 is formed by lands 35 of the plate periodically extending from each side of the plate 30. This construction of the groove 33 by lands 35 extending from each side facilitates the moulding of the mounting plate 30 from a plastics material. The groove 30 is open at one end 36, mounted towards the front of the printer, to allow entry of the tongue 19, and is closed by an endstop 37 at the other end to prevent the tongue 19 from leaving the mounting plate 30. The end 36 of the groove is flared slightly to ease the alignment and entry of the curved end of the tongue 19 into the groove. At the rear end of the mounting plate there is a half eyelet 39 for receiving a screw to retain the rollfeed support in place in the mounting plate 30. The eyelet 39 is not complete but rather comprises a half circle in order to keep the thickness of the mounting plate to a minimum. The thickness t of the mounting plate 30 is less than the length of the feet 11 of the printer so that when the plate is mounted on the underside of the printer, but the rollfeed supports are not attached to the printer, the printer will rest on its feet 11 and not on the mounting plate 30. The mounting plate 30 may be sold together with a pair of rollfeed supports and a media shaft as part of a rollfeed upgrade kit, but is preferably attached to the underside of all printers at the factory so that all printers are easily upgradable without the user needing to attach a mounting plate to the underside of their printer. The mounting plate may of course be integrally incorporated into the underside of the printer rather than being a separate component.

Figure 11:
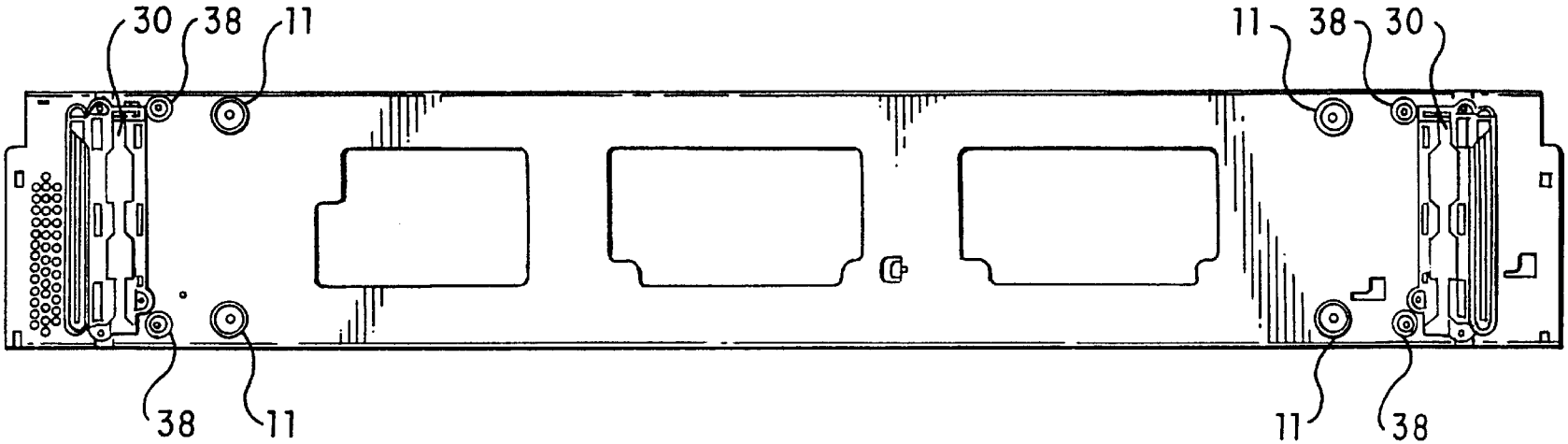
FIG. 11 is a plan view of the underside of a printer.
Figure 12:
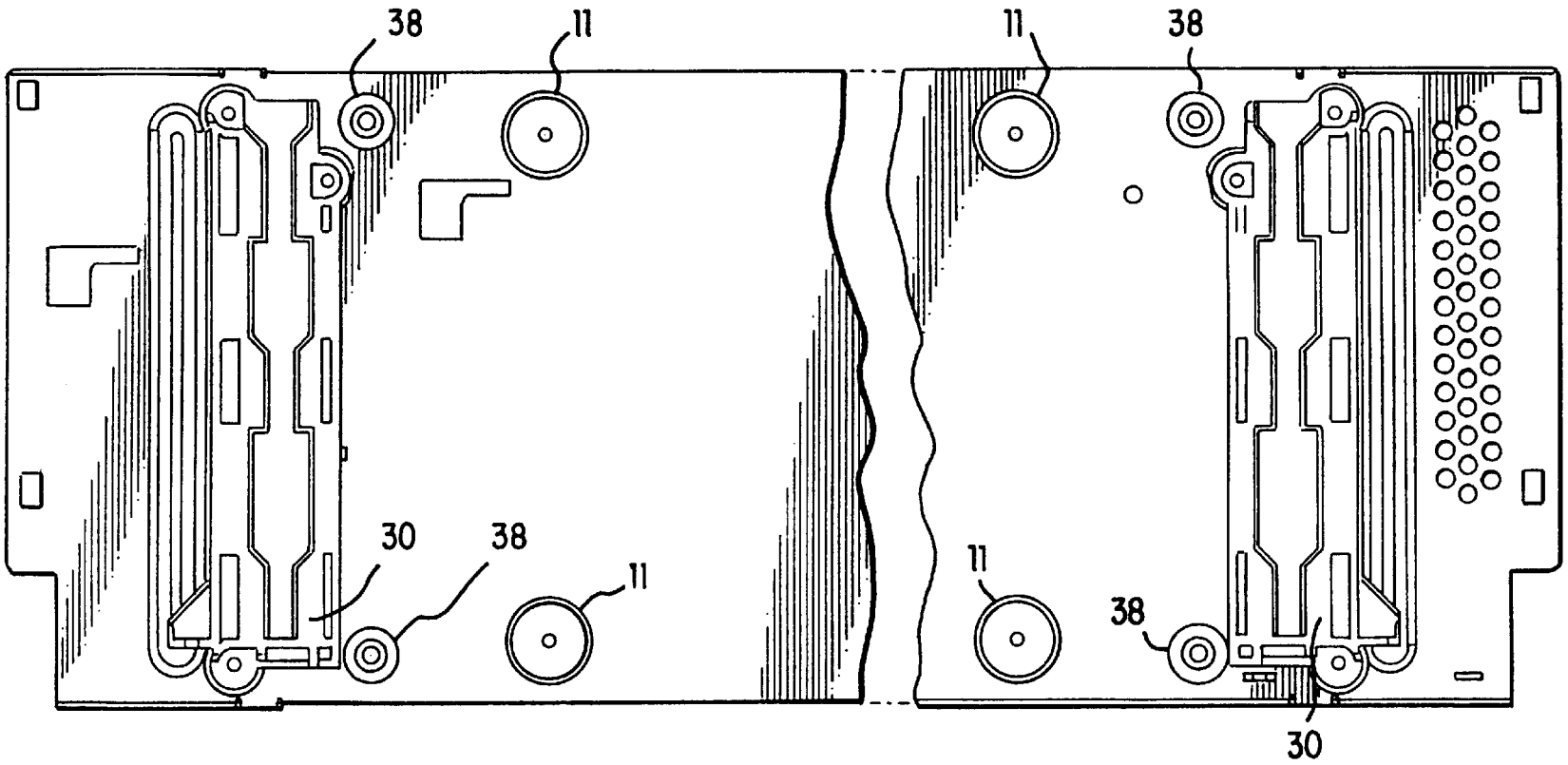
FIG. 12 is an exploded enlarged view of the end sections of the view of FIG. 11.

FIG. 11 is a plan view of the underside of a printer showing the location of four printer feet 1, four mounting points 38 for attaching legs to the printer to convert a desk-mountable printer to a free-standing printer and two mounting plates 30 for receiving a pair of rollfeed supports 13 and 14. As can be seen in the enlarged view of the two end sections of the underside of the printer shown in FIG. 12, the printer feet 11 are closest to the centre of the printer, the mounting plates 30 are furthest from the centre and the mounting points 38 for legs are intermediate these two locations. This order of the various mounting locations facilitates access to them by a user for example when attempting to attach rollfeed supports to a printer which has already had legs attached to it the user is still able to access the rollfeed support mounting plates 30 from both sides of the printer.

Figure 13:
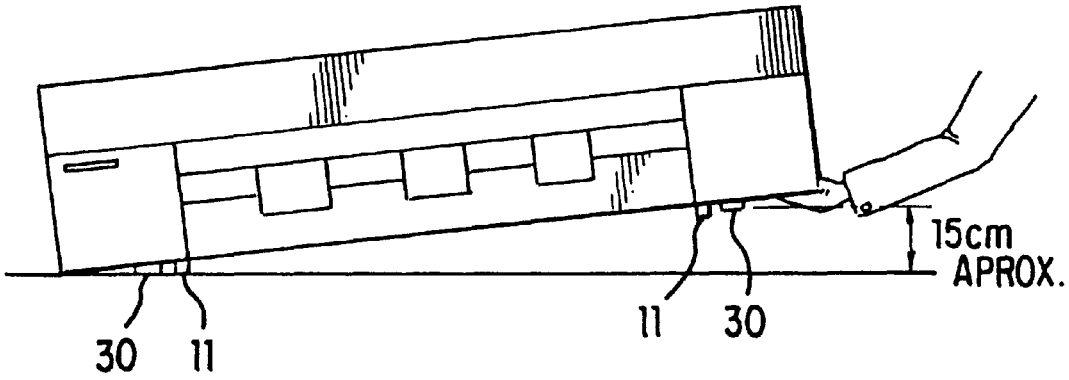
FIG. 13 is a schematic view of a step in the process of attaching a rollfeed support to a desk-mountable printer.
Figure 14:
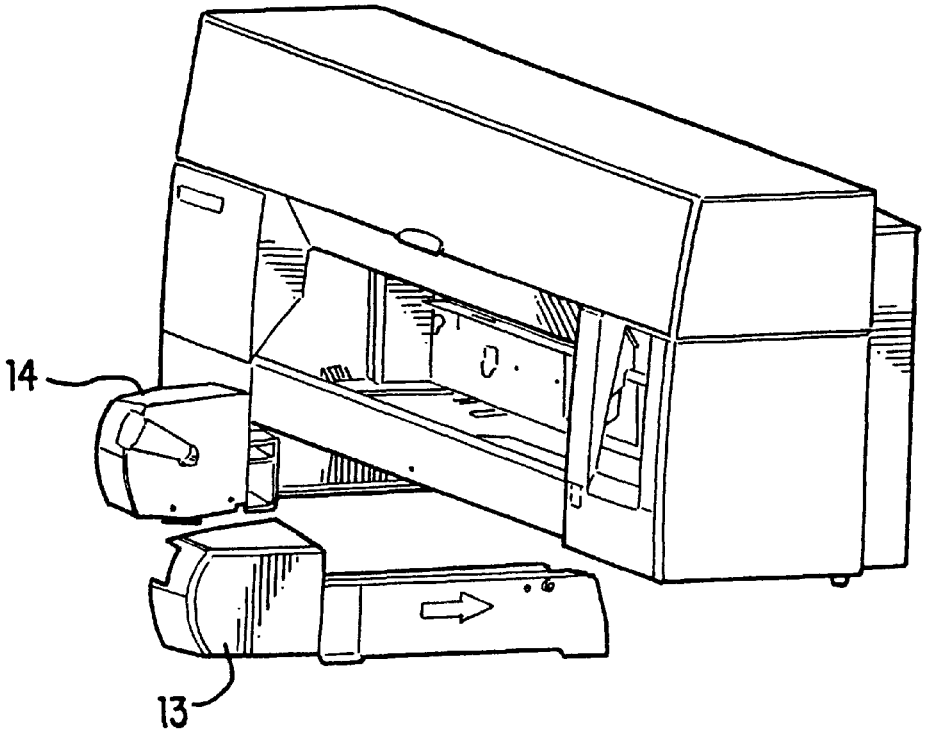
FIG. 14 shows a further step in the process of attaching a rollfeed support to a desk-mountable printer.
Figure 15:
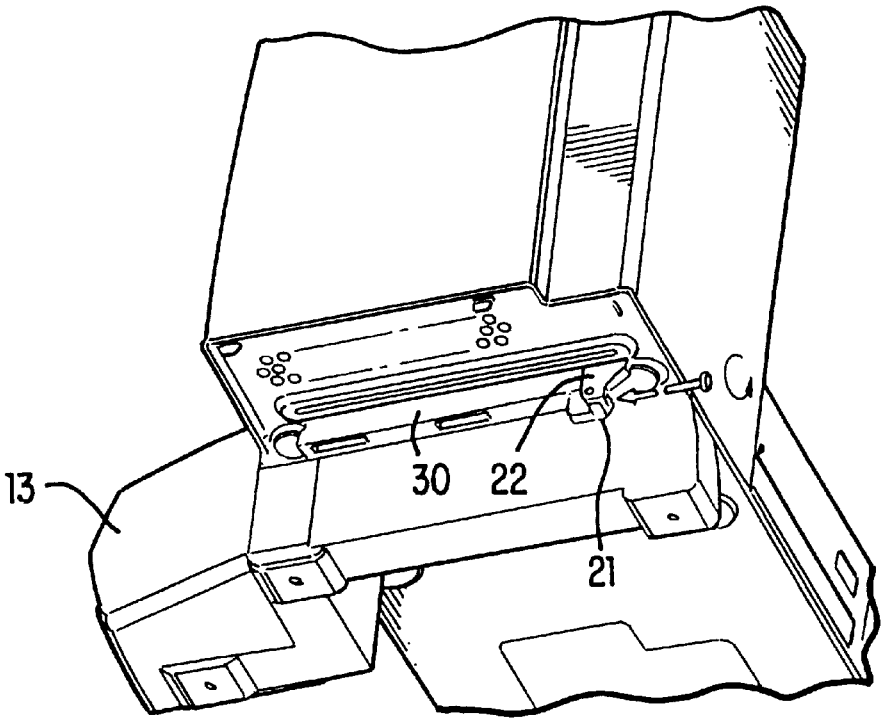
FIG. 15 shows the fixing of a rollfeed support to a mounting plate.

The technique for attaching rollfeed supports to a desk-mountable and free-standing printer will now be described with reference to FIGS. 13 to 19. For a desk-mountable printer firstly one end of the printer is raised slightly from the desk as shown in FIG. 13, only a height of approximately 15 cm is required. While the printer is in this position the appropriate rollfeed support (left or right) is slid into place under this end of the printer. This is achieved by simply placing the tongue 19 on the top of the elongate portion of the rollfeed into the opening 36 of the groove 33 in the mounting plate 30 at this end of the printer and pushing so that the tongue slides along the groove until it meets the endstop 37 of the groove. Once the first rollfeed support is fully located this end of the printer may be lowered to the desk so that it rests on the rollfeed support and the other end of the printer is raised. The second rollfeed support is similarly slid onto the underside of the printer at this other end as shown in FIG. 14 and this end can also be lowered to rest on the second rollfeed support. Finally, a single screw is placed through the half eyelet 39 of the mounting plate 30 and into the eyelet 21 on each rollfeed support, as shown in FIG. 15, in order to prevent the rollfeed support from sliding in the mounting plate. This finally fixture requires very little effort since it is not a load bearing fixture.

Figure 16:
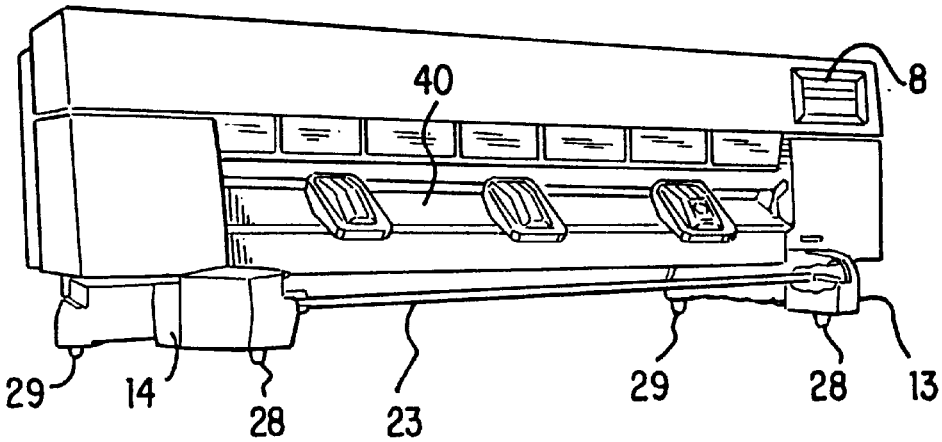
FIG. 16 is a perspective view of a desk-mountable printer with rollfeed apparatus attached.
Figure 17:
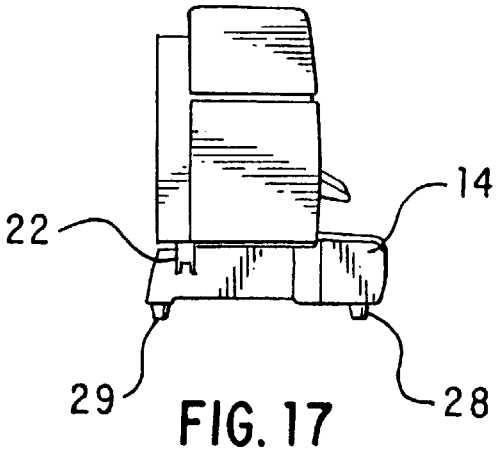
FIG. 17 is a side view of the printer of FIG. 16.
Figure 18:
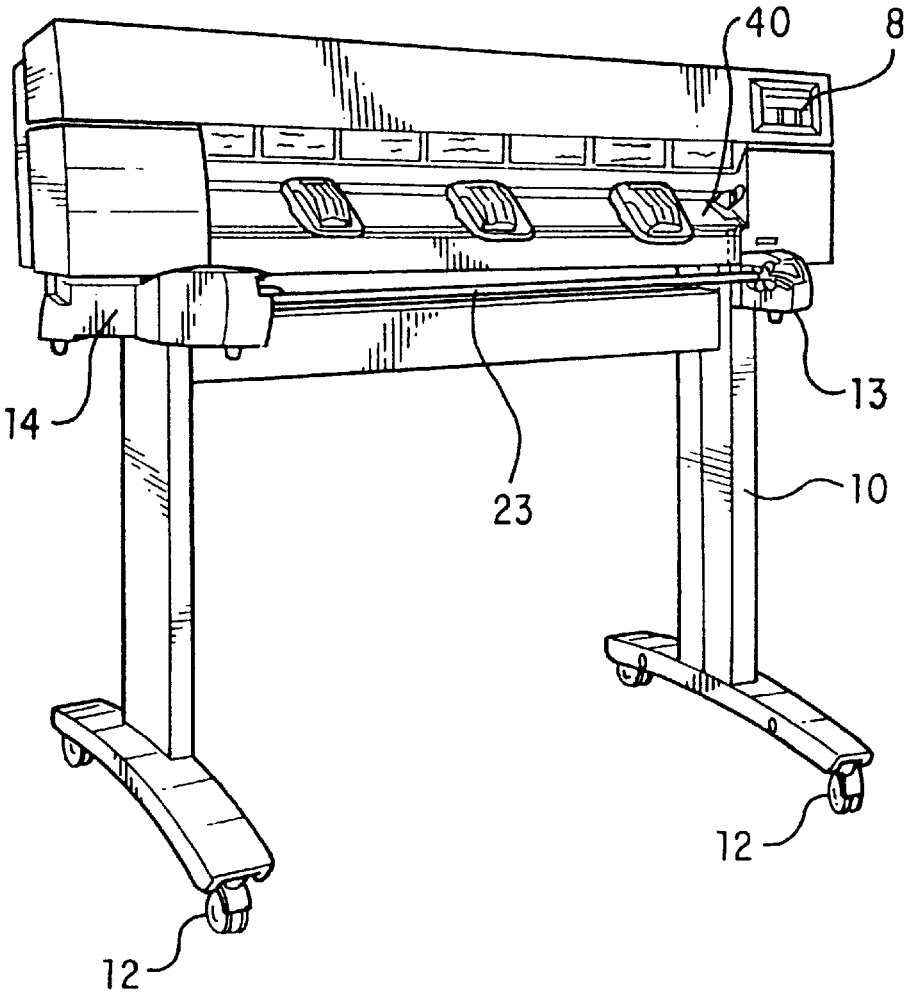
FIG. 18 is a perspective view of a free-standing printer with rollfeed apparatus attached.
Figure 19:
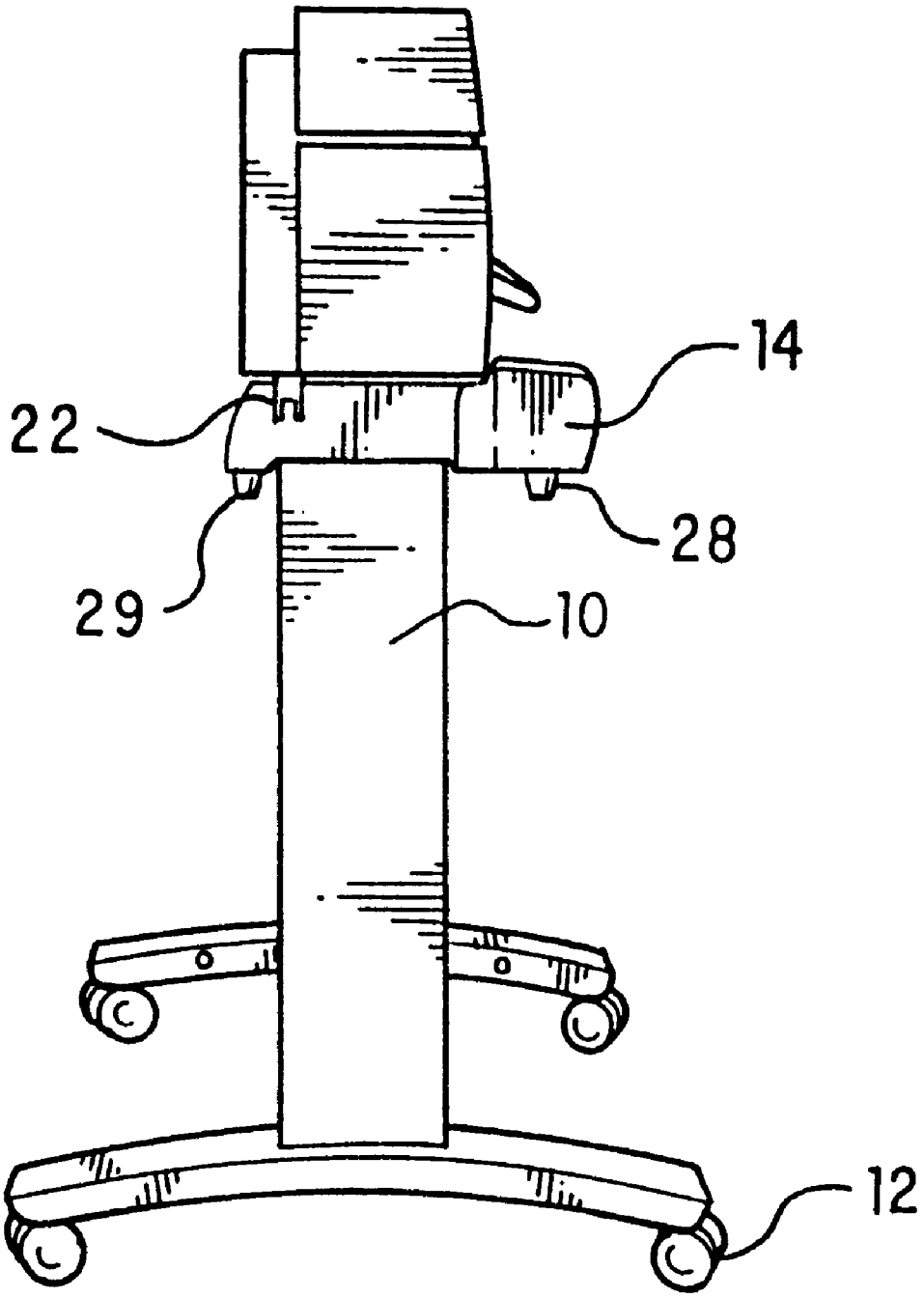
FIG. 19 is a side view of the printer of FIG. 17.

FIG. 16 shows a perspective view of a desk-mountable printer with a pair of rollfeed supports 13 and 14 attached and a media shaft 23 in place between the rollfeed supports. As can be seen the media shaft 23 is held in front of and slightly below the media entry platen 40 of the printer, which is the ideal position for the shaft. In this configuration the weight of the printer is spread between the tongues 19, and the structural extensions 26 of the housing portions of both rollfeed supports 13 and 14 and the only contact with the desk is via the four rollfeed support feet 28 and 29 as can be seen from the side view shown in FIG. 17.

The attachment of a pair of rollfeed supports to a free-standing printer is even easier. The process is substantially identical to that described above for attachment to a desk-mountable printer except that since the printer is raised from the ground by legs 10 the raising step is not necessary to access the mounting plates. Hence, respective left and right rollfeed supports 13 and 14 are simply slid onto the mounting plates 30 at each end of the printer (which are located so that this can be done without fouling on the legs 10) and a screw is placed at each end through the half eyelet 39 as described above. As can be seen from FIGS. 18 and 19 the same ideal position of an inserted media shaft 23 is achieved.

A printing system has thus been described which can be easily, simply and quickly be configured as any one of the following: a desk-mounted printer without rollfeed apparatus attached, a desk-mounted printer with rollfeed apparatus attached, a free-standing printer without rollfeed apparatus attached, or a free-standing printer with rollfeed apparatus attached.

We claim:

1. A removable rollfeed apparatus adapted to be attached by a user to a printer suitable for printing on media fed into the printer either in the form of sheets of media or from a roll of media, the rollfeed apparatus comprising:

mounting means located on an upper portion of said rollfeed apparatus and operable by a user of said printer to releasably and rigidly attach said rollfeed apparatus to an underside of said printer;

holding means, integral to the rollfeed apparatus, for holding both ends of a shaft for a roll of media; and feet attached to a lower portion of said rollfeed apparatus, wherein subsequent to the attachment of said rollfeed apparatus to said printer, the printer is able to rest solely on the rollfeed apparatus.

2. A rollfeed apparatus as claimed in claim 1, comprising a first elongate portion and a second housing portion, said first elongate portion comprising said mounting means for releasably attaching the rollfeed apparatus to the underside of a printer and said second housing portion comprising said holding means for holding both ends of a shaft for a roll of media.

3. A rollfeed apparatus as claimed in claim 2, wherein when the rollfeed apparatus is attached to a printer, said housing portion extends to the front of the printer so that the media shaft is held in front of and below the printer.

4. A rollfeed apparatus as claimed in claim 2, wherein the housing portion comprises means for applying braking friction to the media shaft.

5. A printer suitable for printing on media fed into the printer either in the form of sheets of media or from a roll of media mounted within an optional rollfeed apparatus which rollfeed apparatus is mountable by a user of the printer to the underside of the printer, the printer having mounting positions on the underside of the printer for mounting all of the following:

feet on which the printer may rest on a desktop, legs on which the printer may rest on a floor, and optional, user mountable rollfeed apparatus.

6. A printer as claimed in claim 5, wherein the mounting positions are located so that the feet, the legs and the rollfeed apparatus may simultaneously be attached to the underside of the printer.

7. A printer, suitable for printing on media fed into the printer from a roll of media, the printer having mounting positions on the underside of the printer for mounting:

feet on which the printer may rest on a desktop, legs on which the printer may rest on a floor, and rollfeed apparatus; and wherein the mounting positions are located so that the feet, the legs and the rollfeed apparatus may simultaneously be attached to the underside of the printer; and wherein the mounting positions are located so that the mounting location for the feet is closest to the centre of the printer, the mounting location for the rollfeed apparatus is furthest from the centre of the printer, and the mounting location for the legs is intermediate between the two other mounting locations.

8. A printer suitable for printing on media fed into the printer from a roll of media, the printer having mounting positions on the underside of the printer for mounting:

feet on which the printer may rest on a desktop, legs on which the printer may rest on a floor, and rollfeed apparatus; and further comprising plate means for mounting the rollfeed apparatus to the underside of the printer and printer feet attached to the printer, wherein the feet are longer than the thickness of the plate means so that when the printer is placed on a surface the printer rests on the printer feet.

9. A printer as claimed in claim 8, wherein said plate means comprise a groove for slidably receiving a part of the rollfeed apparatus.

10. A printing system comprising a desk-mountable printer suitable for printing on media fed into the printer from a roll of media, a stand for converting the desk-mountable printer to a free-standing printer and removable rollfeed apparatus mountable on the printer, wherein said printing system is configurable as a desk-mounted printer without rollfeed apparatus attached, a desk-mounted printer with rollfeed apparatus attached, a free-standing printer without rollfeed apparatus attached, and a free-standing printer with rollfeed apparatus attached.

11. A printing system as claimed in claim 10, having rollfeed apparatus comprising support means for holding a roll of media wherein the support means comprise feet attached to a lower portion of the support means and wherein the printer is able to rest on the rollfeed apparatus.

12. A printing system as claimed in claim 11, wherein when a printer is resting on said support means a part of the support means extends to the front of the printer so that a media shaft held in the support means is located in front of and below the printer.

* * * * *